US009409135B2

(12) United States Patent
Rupp

(10) Patent No.: US 9,409,135 B2
(45) Date of Patent: Aug. 9, 2016

(54) SELF RETAINING APPARATUS MIXING FLUIDS

(71) Applicant: Snowie LLC, Salt Lake City, UT (US)

(72) Inventor: Carl A. Rupp, Salt Lake City, UT (US)

(73) Assignee: Snowie LLC, Salt Lake City, UT (US)

( * ) Notice: Subject to any disclaimer, the term of this patent is extended or adjusted under 35 U.S.C. 154(b) by 581 days.

(21) Appl. No.: 13/673,920

(22) Filed: Nov. 9, 2012

(65) Prior Publication Data

US 2014/0133267 A1 May 15, 2014

(51) Int. Cl.

| | |
|---|---|
| ***B01F 13/00*** | (2006.01) |
| ***B01F 7/00*** | (2006.01) |
| ***B01F 15/00*** | (2006.01) |

(52) U.S. Cl.

CPC ..... *B01F 7/00116* (2013.01); *B01F 7/0015* (2013.01); *B01F 7/00141* (2013.01); *B01F 7/00291* (2013.01); *B01F 13/003* (2013.01); *B01F 13/0028* (2013.01); *B01F 15/00662* (2013.01)

(58) Field of Classification Search

CPC ..... B01F 15/00662; B01F 15/00681; B01F 15/0072; B01F 7/002; B01F 7/0016; B01F 13/0028; B01F 13/003

USPC ..... 366/249, 349, 251, 129, 282

See application file for complete search history.

(56) References Cited

U.S. PATENT DOCUMENTS

| | | | | |
|---|---|---|---|---|
| 3,223,389 | A * | 12/1965 | Simmonds | 366/282 |
| 4,396,291 | A * | 8/1983 | Simmonds | 366/282 |
| 5,613,425 | A * | 3/1997 | Krznaric | 99/348 |
| 5,941,636 | A * | 8/1999 | Lu | 366/249 |
| 2003/0193835 | A1 * | 10/2003 | Richardson | 366/282 |

* cited by examiner

*Primary Examiner* — Charles Cooley
*Assistant Examiner* — Marc C Howell
(74) *Attorney, Agent, or Firm* — Terrance J. Edwards; TechLaw Ventures, PLLC

(57) ABSTRACT

A portable, self-retaining apparatus, system and method for mixing fluids in a container is disclosed. The self-retaining, portable fluid mixing apparatus is capable of being connected to a container and retained thereon without the aid of a user during use. The self-retaining fluid mixing device, system and method of the disclosure may be used in various capacities to mix a wide variety of fluids having a wide variety of viscosities. Thus, the disclosure is not limited to any particular type of fluid or viscosity, but an example of the fluids that may be mixed include flavoring syrups and thickeners used for shaved ice confectioneries. The mixer or apparatus can be quickly attached to and detached from a container without the use of extraneous, cumbersome fasteners. The torque caused by operation of the motor causes the apparatus and system to lock in place during use, such that when the torque is released, the apparatus may be quickly and easily removed from the container.

32 Claims, 14 Drawing Sheets

SELF RETAINING APPARATUS MIXING FLUIDS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The disclosure relates generally to fluid mixing devices, and more particularly, but not necessarily entirely, to a self-retaining, portable fluid mixing device capable of being connected to a container and retained thereon without the aid of a user.

The self-retaining fluid mixing device and method of the disclosure may be used in various capacities to mix a wide variety of fluids having a wide variety of viscosities. Thus, the disclosure is not limited to any particular type of fluid or viscosity. An example of fluids that may be mixed by the self-retaining device of the disclosure include flavoring syrups and thickeners used for shaved ice confectioneries. As disclosed herein below, the mixer or apparatus of the disclosure can be quickly attached to and detached from a container without the use of extraneous, cumbersome fasteners. The torque caused by operation of the motor causes the apparatus and system to lock in place during use, such that when the torque is released, the apparatus may be quickly and easily removed from the container.

A variety of machines have been developed, described and are widely known for mixing fluids. However, despite the advantages of such machines, improvements are still being sought. Machines in the marketplace may have limitations such as, cumbersome procedures requiring the user to hold onto or grasp the machine while in use requiring unnecessary human capital to mix the fluids, large machines that are difficult to manually carry or move from one location to another in a timely manner, or because the machine is heavy and unwieldy such that the user may not easily move the machine from one container to another. Such machines tend to cause slowness to the overall operation, which may be disadvantageous in industries where speed is required. For example, slow machines or machines that require large amounts of human capital to operate can reduce the efficiency of a business. In various industries, for example a shaved ice business or any other business in the concessions industry, it is important for the success of that business to move customers through a waiting line quickly to finalize the sale of a confectionary product to customers. In the example of a shaved ice business, the ability to quickly mix flavor syrups on the job site is imperative to the success of a shaved ice concession stand, especially in locations where time is of the essence, for example at a halftime break at a sporting event or other intermission. Otherwise, when mixing flavors or other fluids consumes too much time the business will lose out on the opportunity to make a sale because the break is either over or the customers are tired of waiting in long lines.

Machines in the marketplace may thus be characterized by several disadvantages that may be addressed by the disclosure. The disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like which has been included in the present specification is not to be taken as an admission that any or all of these matters form part of the prior art base, or were common general knowledge in the field relevant to the disclosure as it existed before the priority date of each claim of this application.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
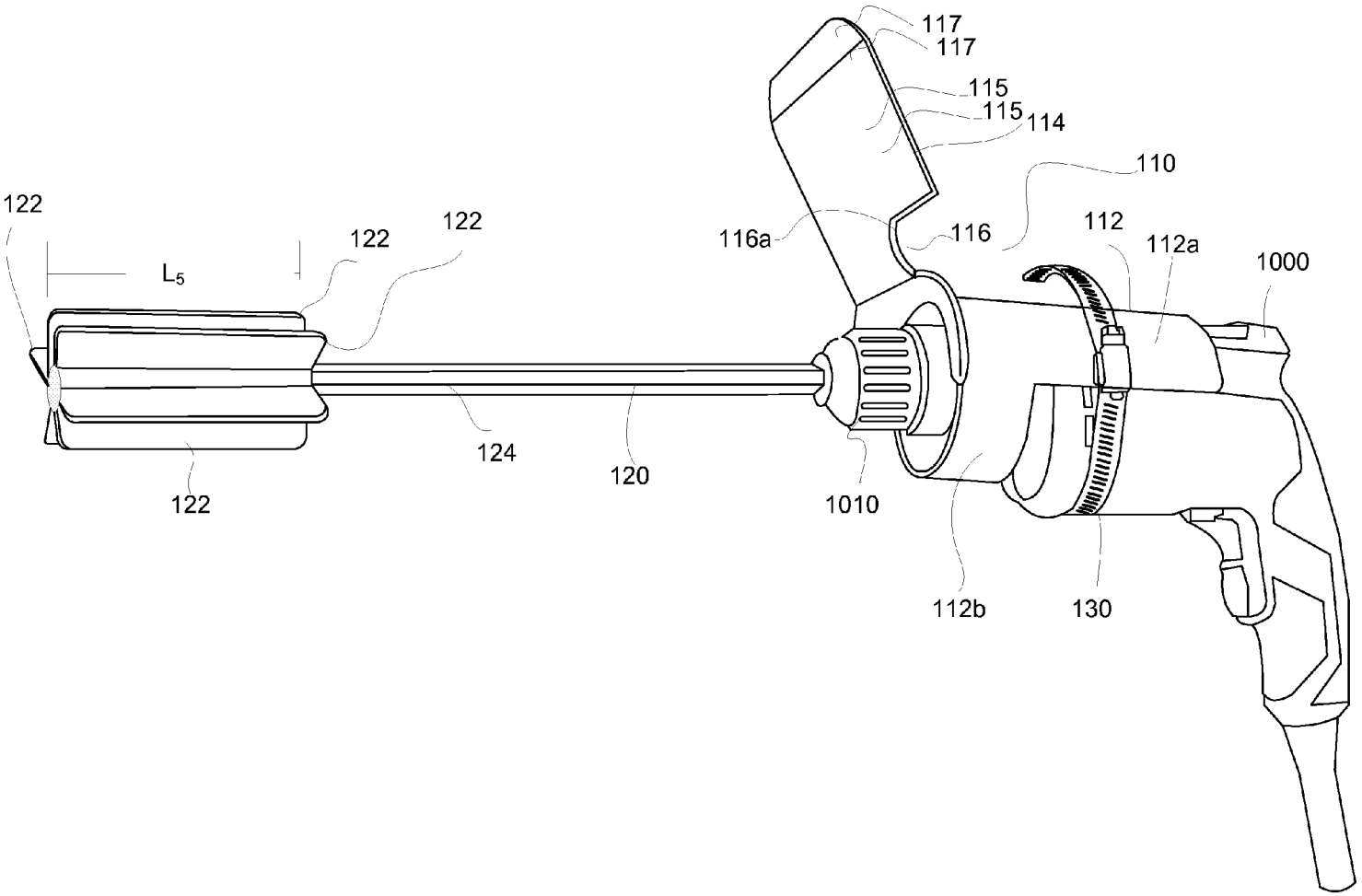
FIG. 1 is a perspective side view of a self-retaining apparatus and system for mixing fluids in a container made in accordance with the teachings and principles of the disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the apparatus, system and methods for mixing fluids in a container are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

As used herein, the term "motor" refers to a power source that imparts torque; or any rotating pneumatic or air motor, which does mechanical work by expanding compressed air; or any electromagnetic device used to convert electrical energy into mechanical energy; whether or not the power source, motor or electromagnetic device is housed within or as part of another device, such as a drill or other mechanical device.

As used herein, the term "proximal" shall refer broadly to the concept of a nearest portion.

As used herein, the term "distal" shall generally refer to the opposite of proximal, and thus to the concept of a further portion, or a furthest portion, depending upon the context.

Referring now to the drawings and specifically to FIGS. 1-4, a self-retaining apparatus and system for mixing fluids within a container is illustrated. The self-retaining apparatus 100 for mixing fluids within a container 200 may comprise a frame member 110 and a mixing paddle 120. As illustrated best in FIG. 1, the frame member 110 may be mechanically coupled to a motor 1000 via a fastening member 130 or other coupling device. The mixing paddle 120 may be mechanically coupled to the motor 1000 via a coupling device 1010. In an embodiment, the motor 1000 may be an electric motor contained in a standard power drill or cordless drill. In an embodiment, the motor 1000 may be any electric motor, including but not limited to a three phase, alternating current, or direct current electric motor. In an embodiment, the motor 1000 may be a pneumatic or air motor.

Figure 4:
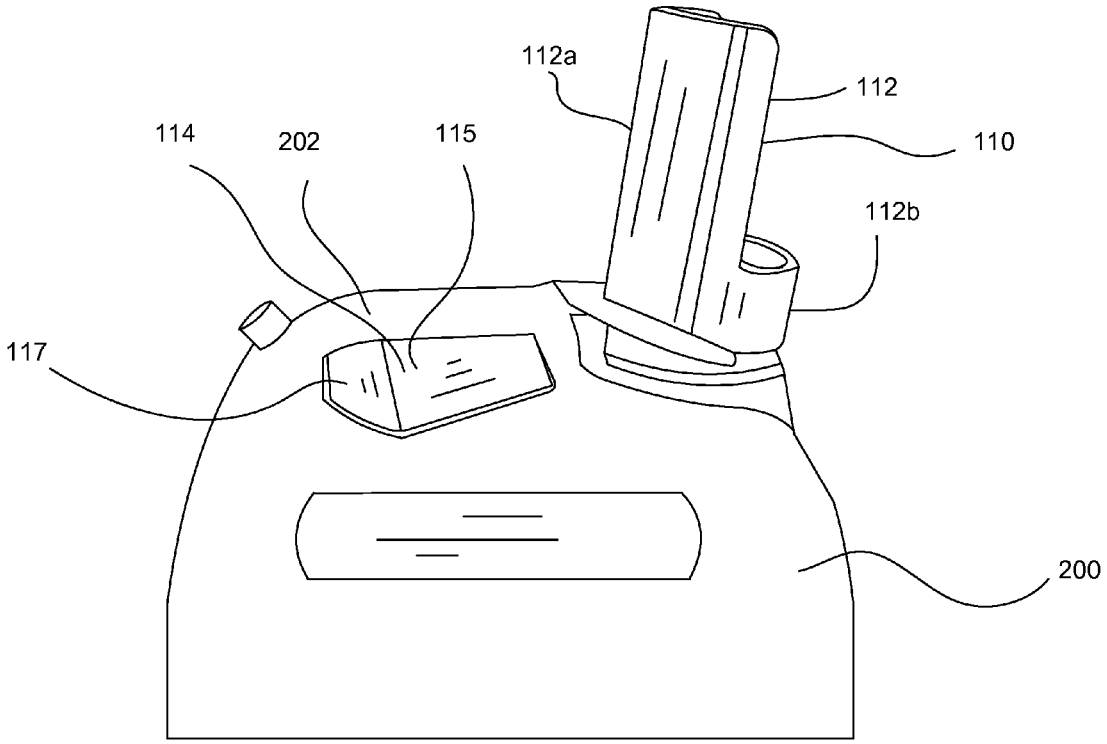
FIG. 4 is a view of the mixing saddle seated in the container and that used as part of the self-retaining apparatus and system for mixing fluids in said container made in accordance with the teachings and principles of the disclosure.

The frame member 110 may comprise a saddle 112 and a securing plate 114 for connecting the frame member 110 to a handle 202 or other portion of the container 200 and retaining the frame member 110 with respect to the container 200 (illustrated best in FIG. 4). The container 200 may be a 5 gallon container that is commonly used in the field of confectionary products, such as shaved ice products to store and dispense flavoring syrups or concentrate. The frame member 110 may further comprise a slot 116 that may be configured and dimensioned to interact with and contact the handle 202 or other portion of the container 200, to thereby connect and retain the frame member 110 in a definite location with respect to the container 200 without requiring a user to physically hold or otherwise maintain the apparatus 100 in place while the motor 1000 is in use.

Figure 3:
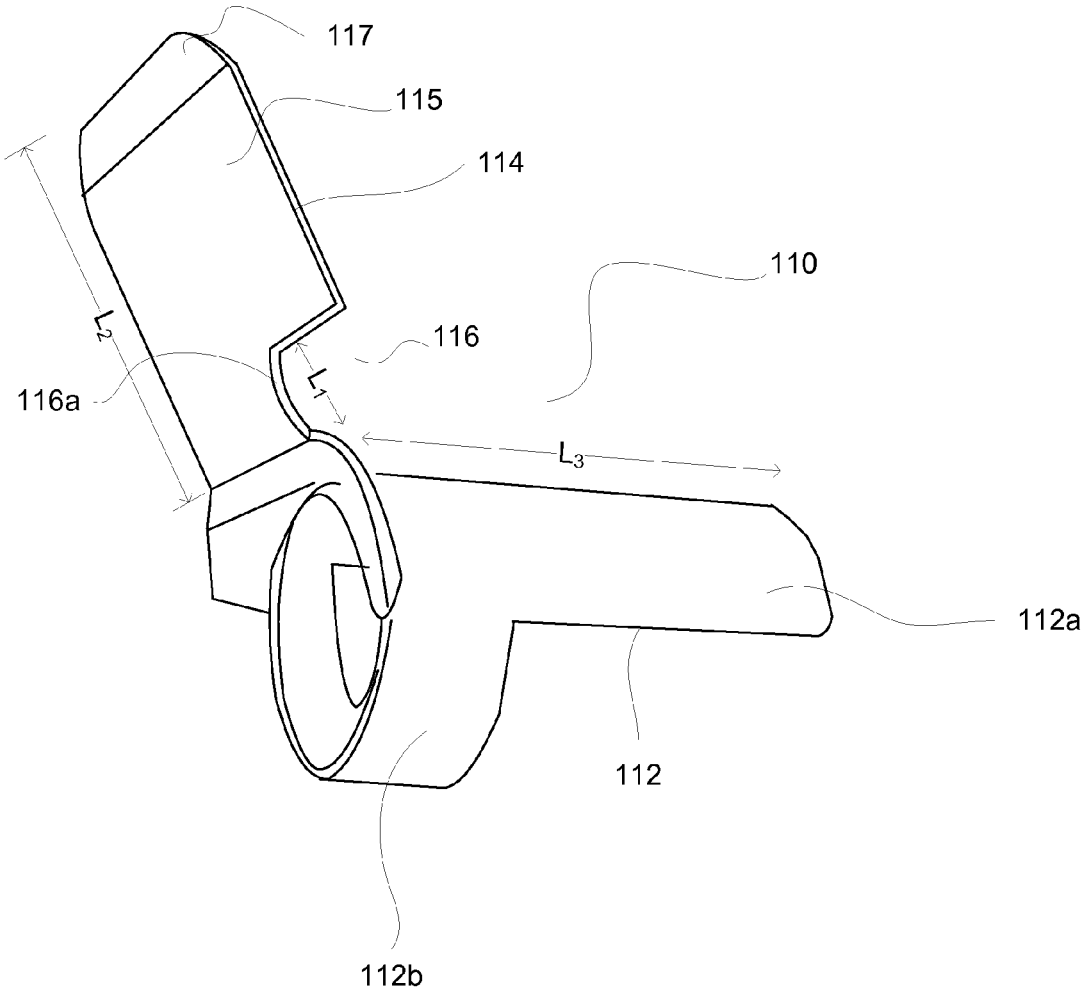
FIG. 3 is a perspective side view of a mixing saddle used as part of the self-retaining apparatus and system for mixing fluids in a container made in accordance with the teachings and principles of the disclosure.

It will be appreciated that in an embodiment, the slot 116 may be substantially formed in or as part of the securing plate 114 as illustrated in FIGS. 1, 3 and 4. The slot 116 may comprise a sidewall 116*a* that substantially defines the boundary and shape of the slot 116. When in use, the slot 116 may interact with the handle 202 or other portion of the container 200, such that when the motor 1000 is actuated or operated, the torque caused by the operation of the motor 1000 forces the sidewall 116*a* defining the slot 116 to move into contact with the handle 202 or other portion of the container 200 to thereby retain the frame member 110 in a certain location without requiring a user to grasp and hold the self-retaining apparatus 100 during use. As noted more fully below, the structure and design of the frame member 110 allows a user to quickly and easily connect and lock the entire device and system, including the frame member 110 and the mixing paddle 120, to the container 200 or jug and thereafter release and move the entire device and system from one container 200 to another for quick and efficient mixing.

The securing plate 114 may comprise a substantially planar first portion or surface 115 that may have an end that forms or defines a top portion of the slot 116 (illustrated best in FIGS. 1 and 3). The securing plate 114 may further comprise a substantially planar second portion or surface 117. The second portion or surface 117 may be formed at an angle θ with respect to the first portion or surface 115, such that the first portion 115 and the second portion 117 are not co-planar. The angle θ formed between the first portion 115 and the second portion 117 may fall within a range of about ten degrees and about thirty degrees, or about fifteen degrees to about twenty-five degrees, or about twenty degrees. The first portion 115 and the second portion 117 may be used to anchor or support the frame member 110 in a substantially upright position with respect to the container 200 (illustrated best in FIG. 4), such that the mixing paddle 120 may be located directly into the container to mix fluids contained therein. It will be appreciated that portions of the saddle 112 may also be used to support the frame member 110 with respect to the container 200, such that virtually no assistance by the user is required, other than the initial set-up and take-down of the apparatus or system with respect to the container 200.

In an embodiment, to retain the frame member 110 when torque is applied to the drive shaft 124 and plurality of paddles or blades 122, the slot 116 is provided. The slot 116 may be positioned between the securing plate 114 on one side and the saddle 112 on the other side, such that the slot 116 is structurally supported. The slot 116 may be formed such that when torque is applied, the torque forces the structural supports of the frame member 110 into contact with portions of the container 200, such as a base of the handle 202. The slot may be defined by portions of the saddle 112 and the securing plate 114 (illustrated best in FIGS. 1 and 3). The slot 116 may be located proximally with respect to the saddle 112 and distally with respect to the second portion 117 of the securing plate 114. Additionally, the slot 116 may be located at a base of the first portion 115 of the securing plate 114.

The slot 116 may comprise a ratio between a length $L_1$ of the slot 116 to a length $L_2$ of the securing plate 114 that is within a range of about 0.15 to about 0.75, or within a range of about 0.20 to about 0.50, or within a range of about 0.25 to about 0.30.

The saddle 112 may comprise a first portion 112*a* having a curved surface for engaging a housing for the motor 1000, and a second portion 112*b*, which may comprise a tubular portion, for interacting with or receiving a portion of the housing of the motor 1000 therein. The curved surface may comprise a friction member, such as a rubber padding material, used to hold the motor 1000 with respect to the frame member 110. The second portion 112*b* may comprise a coupling device for coupling the frame member 110 to a portion of the container 200, which leads to an opening 202 of said container 200. More specifically, the second portion 112*b* of the saddle 112 may be coupled to a lip 204 of the opening 202 of the container 200 (illustrated best in FIGS. 4-14), such that the second portion 112*b* in combination with the securing plate 114 may interact with the container 200 to retain the apparatus with respect to the container 200.

In an embodiment, the tubular portion of the second portion 112*b* may be sized and shaped to fit around or within the lip 204 of the container 200 to help structurally support the frame member 110. It will be appreciated that the saddle 112 may be configured and dimensioned to couple, attach or otherwise connect the frame member 110 to the motor 1000 and to the container 200. The tubular portion may be inserted over the threads of the opening of the container 200 (illustrated in FIGS. 4-14) without threadedly engaging the opening. The tubular portion assists in securing the motor 1000, such that movement of the motor is limited and such that the mixing paddle 120 is located and oriented in the desired position with respect to the space of the container.

When the frame member 110 is attached to the container 200 (illustrated best in FIG. 4), the saddle 112 may be in a substantially upright position as illustrated. However, it will be appreciated that in order to center the mixing paddle 120 within the center of the space in the container 200 (so as to not bump the side of the container thereby causing potential contamination during the mixing process), the saddle 112 and the frame member 110 generally must be offset due to the location of the lip of the opening of the container 200. Accordingly, the saddle 112 may comprise an axis A-A as illustrated in FIG. 4 that forms an angle $\pi$ with respect to an imaginary horizontal line B-B that is parallel to an axis of the handle 202 of the container 200, wherein the angle is greater than ninety degrees and may be between a range of about ninety-five degrees to about one-hundred and twenty degrees. It will be appreciated that the angle may be any angle that is greater than ninety degrees and may be modified in order to locate the plurality of blades 122 near the center of the space inside the container in order to create enough chaotic mixing to sufficiently mix the fluid inside the container.

In addition, a ratio between a length $L_3$ of the saddle 112 to the length $L_2$ of the securing plate 114 may exist that may be within a range of about 1 to about 1.25, or between a range of about 1.10 and about 1.20.

Figure 2:
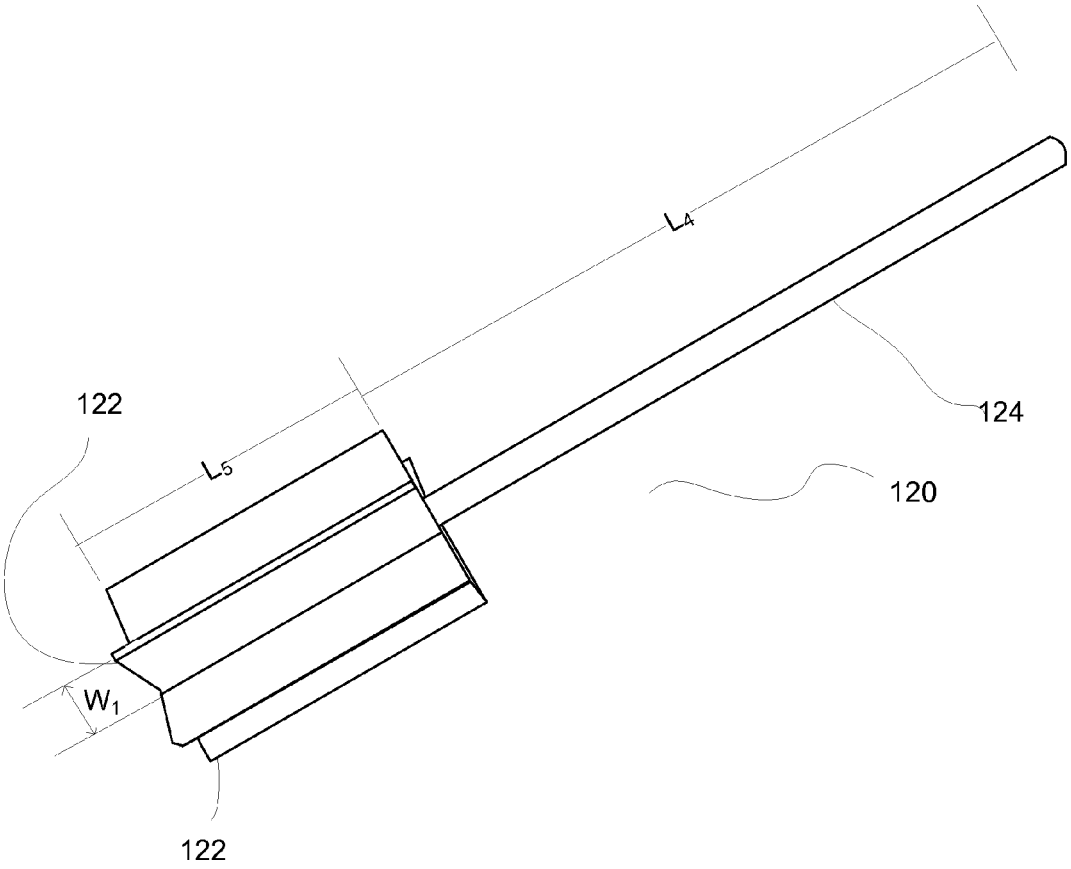
FIG. 2 is a perspective side view of a mixing paddle used as part of the self-retaining apparatus and system for mixing fluids in a container made in accordance with the teachings and principles of the disclosure.

Referring specifically to FIGS. 1 and 2, the mixing paddle 120 may comprise a plurality of blades 122 and a drive shaft 124. The plurality of blades 122 may be in mechanical communication with the drive shaft 124. The drive shaft 124 may be in mechanical communication with the motor 1000, such that when the motor 1000 is actuated the drive shaft 124 rotates thereby imparting torque from the motor 1000 to the plurality of blades 122 due to the mechanical communication between the motor 1000, drive shaft 124 and plurality of blades 122.

It will be appreciated that the plurality of blades 122 may be manufactured from any suitable material, including but not limited to rubber or other polymeric materials, metal, metal alloys, or other suitably strong material that is sufficient for mixing fluids. In addition, when mixing food grade fluids, such as flavoring syrups and concentrates, the plurality of blades 122 should be manufactured from food grade materials.

The drive shaft 124 may comprise a length $L_4$ that may be sufficiently long to extend the plurality of blades 122 into the middle space of the container 200 in order to create a chaotic or turbulent mixing within the container. For example, the length $L_3$ may be within a range of about eight to about sixteen inches, or may be about twelve inches if used with a 5 gallon container that is commonly found and used in the flavored syrup industry. However, it will be appreciated that the length $L_3$ may be larger or smaller than the specified range and may be dictated by the size of the container used.

The plurality of blades 122 may be configured and dimensioned to cause chaotic or turbulent flow in the container when torque is applied. Further, the plurality of blades 122 may comprise an overall diameter that is dictated by the diameter of the opening of the container 200. For example, in the embodiment illustrated in FIG. 4, the diameter of the plurality of blades 122 corresponds with the diameter and size of the opening of the container 200. Thus, as the size of the diameter of the opening of the container 200 increases or decreases, the overall diameter of the plurality of blades 122 will increase or decrease, such that the blades fit through the opening and into the container, but have a great enough surface area to create chaotic or turbulent flow. Accordingly, each of the blades 122 may comprise a length $L_5$ that is within a range of about 50 millimeters to about 150 millimeters, and may be within a range of about 75 millimeters to about 95 millimeters or may be about 80 millimeters to about 85 millimeters. Additionally, each of the blades 122 may comprise a width $W_1$ that is within a range of about 10 millimeters to about 30 millimeters or may be about 18 millimeters.

The disclosure also contemplates a system for mixing fluids within a container 200. The system may comprise a motorized device, such as a drill for example, that is capable of providing torque. The system may also comprise a self-retaining apparatus that may itself comprise a frame member 110 that is mechanically coupled to a motor 1000. The frame member 110 may comprise a saddle 112 and a securing plate 114 for connecting and retaining the frame member 110 with respect to a container 200. The system may also comprise a mixing paddle 120. The mixing paddle 120 may comprise a plurality of blades 122 and a drive shaft 124. The plurality of blades 122 may be in mechanical communication with the drive shaft 124. In turn, the drive shaft 124 may be in mechanical communication with the motor 1000, such that when the motor 1000 is actuated or operated the drive shaft 124 rotates thereby imparting torque from the motor 1000 to the plurality of blades 122 due to the mechanical communication between the motor 1000, drive shaft 124 and plurality of blades 122. It will be appreciated that the frame member 110 may comprise a slot 116 that may be configured and dimensioned to interact with and contact a portion of the container 200 to thereby connect and retain the frame member 110 in a certain location with respect to the container 200 without requiring a user to grasp and hold the self-retaining apparatus in place during use.

When the fluid product, such as a flavoring agent or a flavoring syrup comprised of water and sugar, is mixed in the container 200, the motor 1000 is initially turned off. When the motor 1000 is operated or actuated, the torque caused by the motor operates to force the frame member 110 to lock into position with respect to the handle 202 of the container as discussed above. When the motor is turned off the torque is also removed from the apparatus, thereby releasing the load placed thereon and essentially unlocking the apparatus from the handle 202 of the container 200. With the apparatus in a freed state, the apparatus can be easily removed and located on the next container or jug for mixing additional fluids. There is no need for any extraneous fasteners or further mechanical attachments or couplers other than the structures disclosed herein, such as screws, bolts, and the like, to secure the apparatus to the container. Thus, the apparatus is a self-retaining apparatus that is simple in design and operation. The apparatus also provides significant time savings because a single operator is able to prepare the next, second container containing the fluid to be mixed, while the apparatus is operating and mixing the fluid in the first container (illustrated best in FIGS. 5-14).

Figure 5:
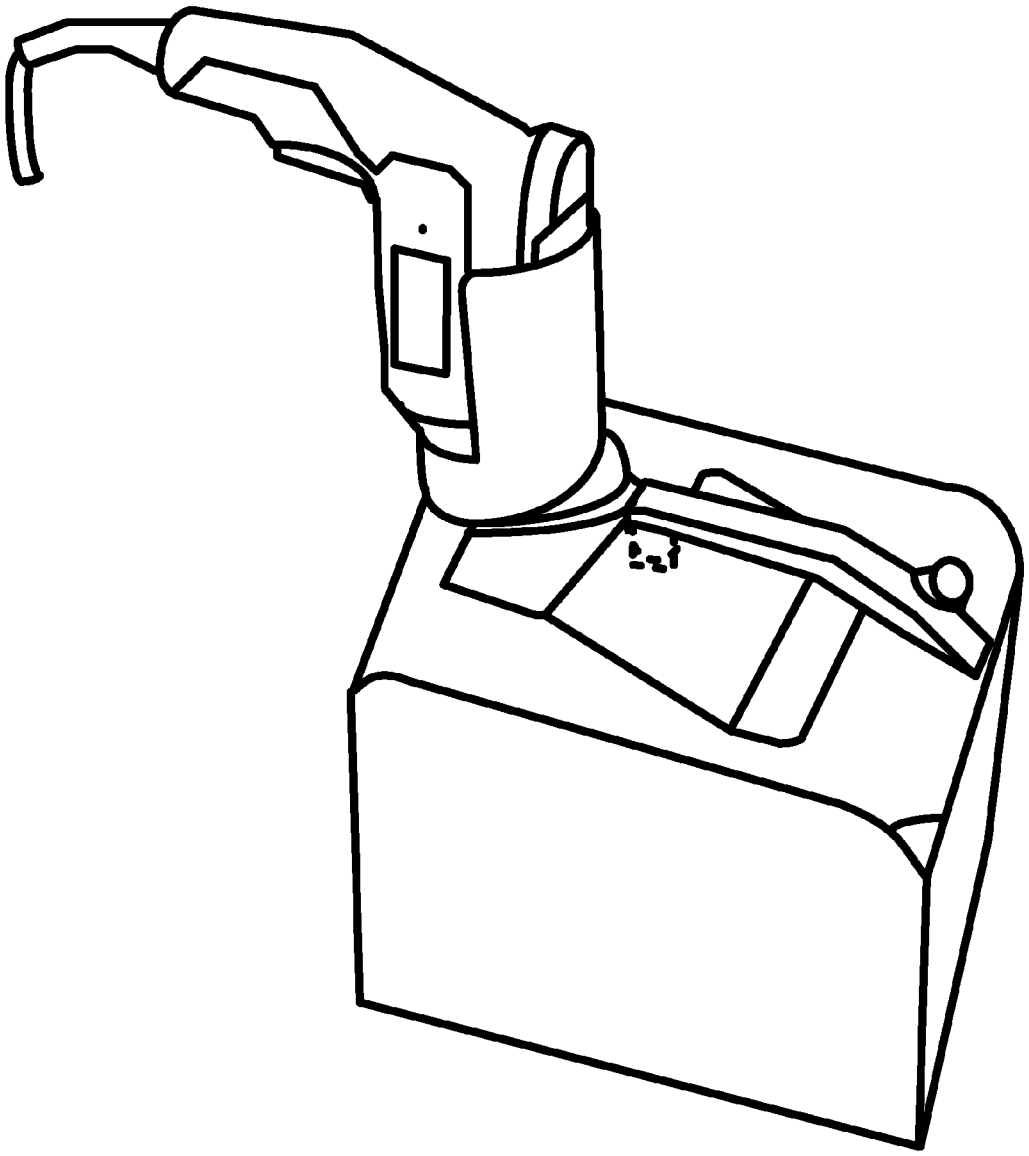
FIGS. 5-14 illustrate the method of use of an embodiment of the apparatus and system disclosed herein.
Figure 6:
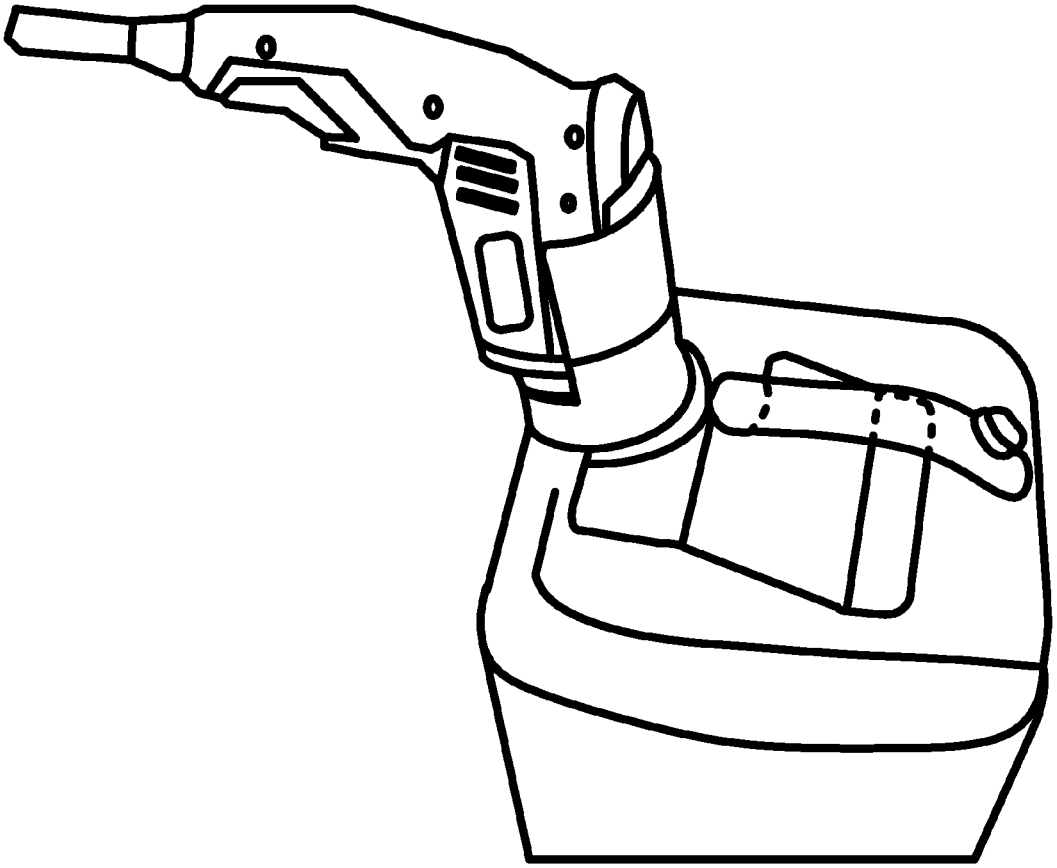
Figure 7:
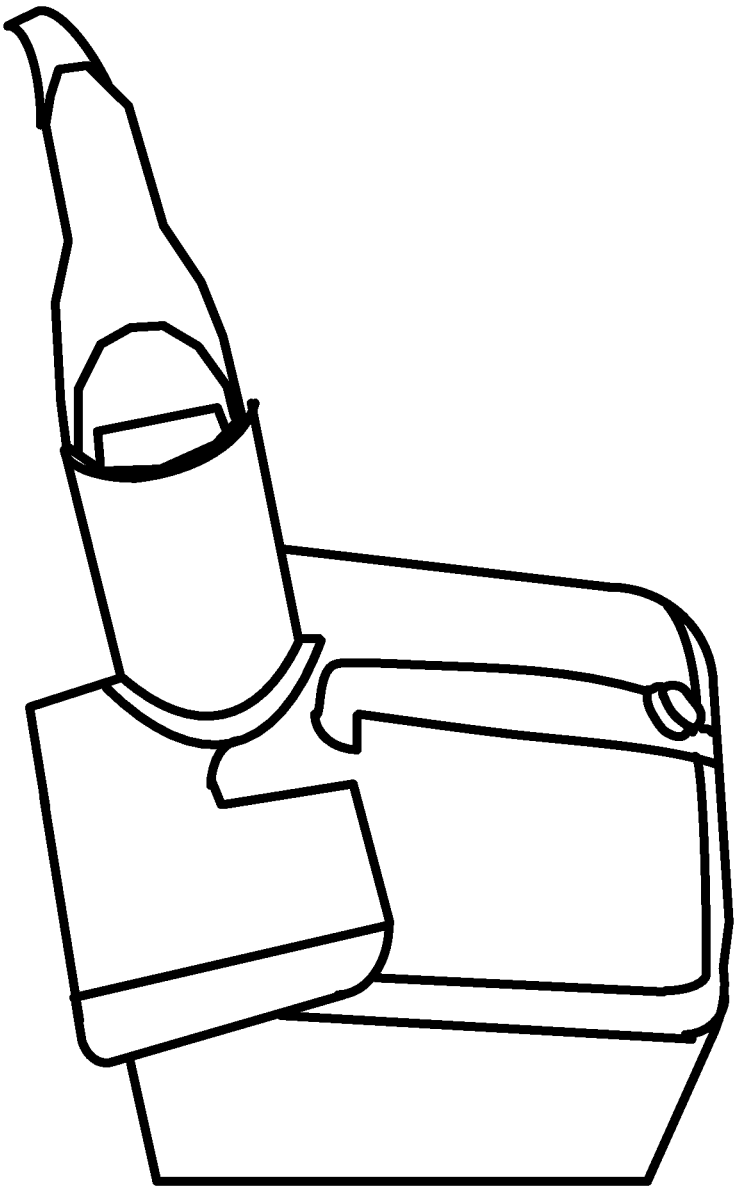
Figure 8:
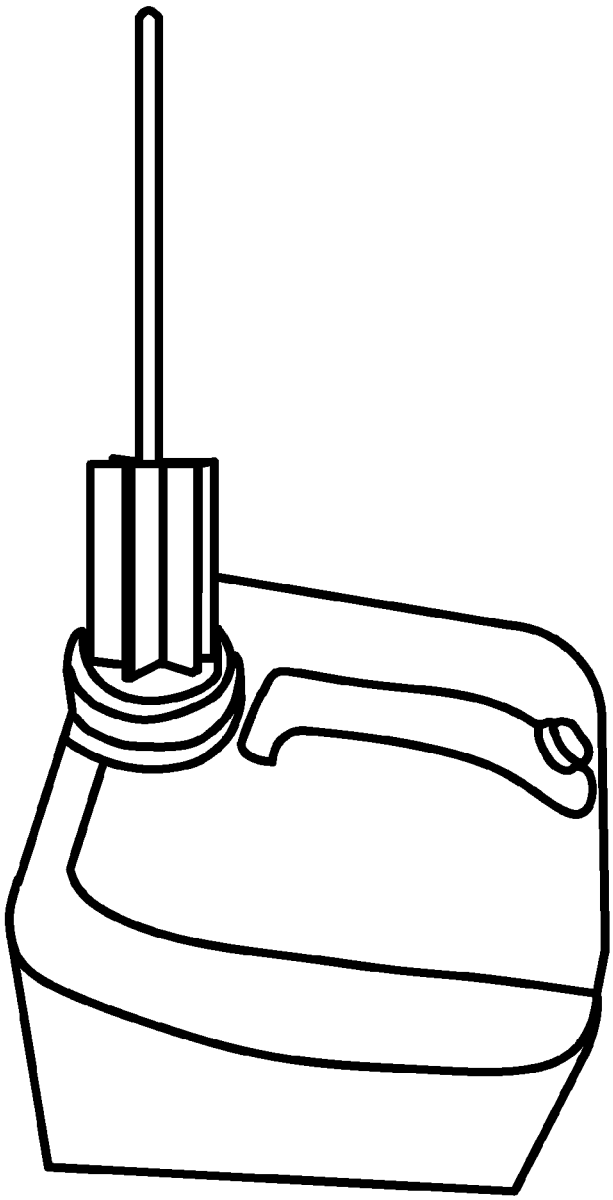
Figure 9:
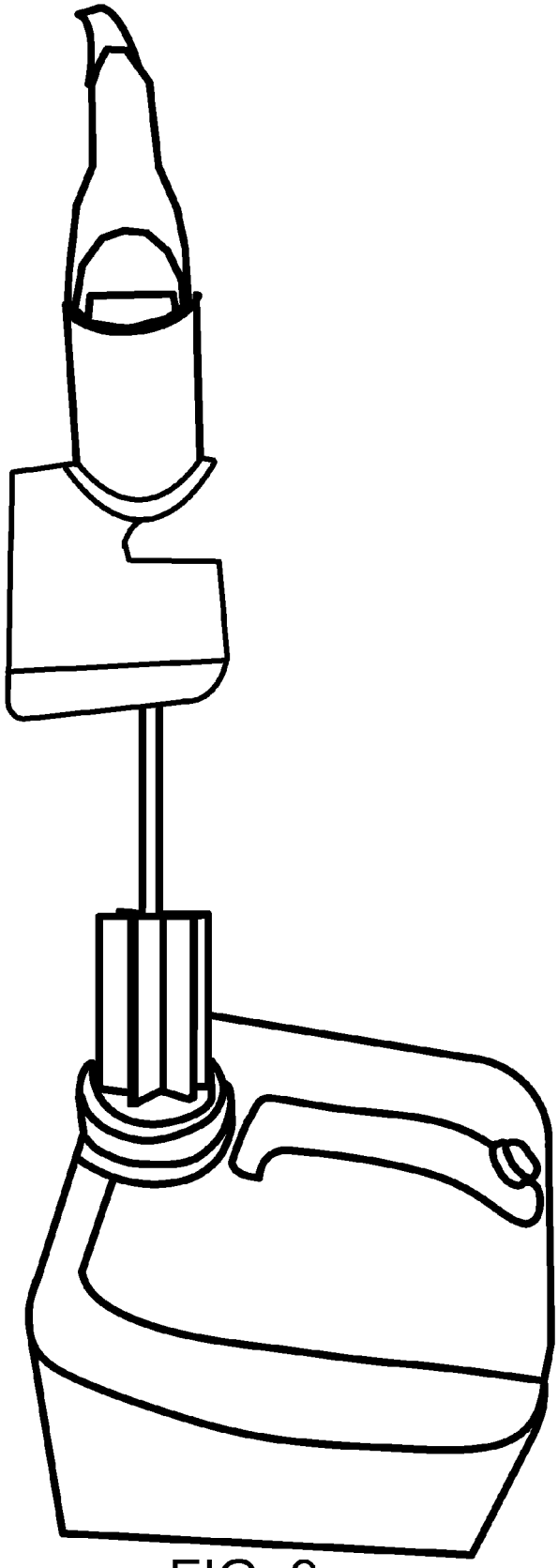
Figure 10:
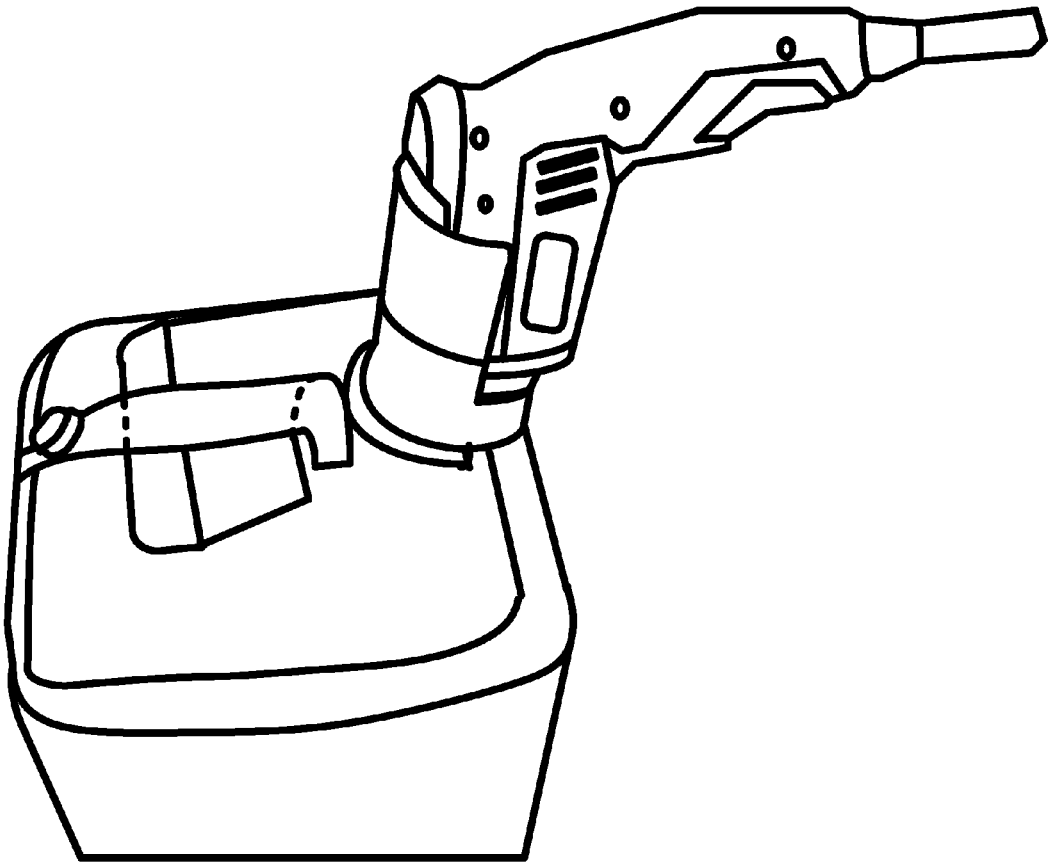
Figure 11:
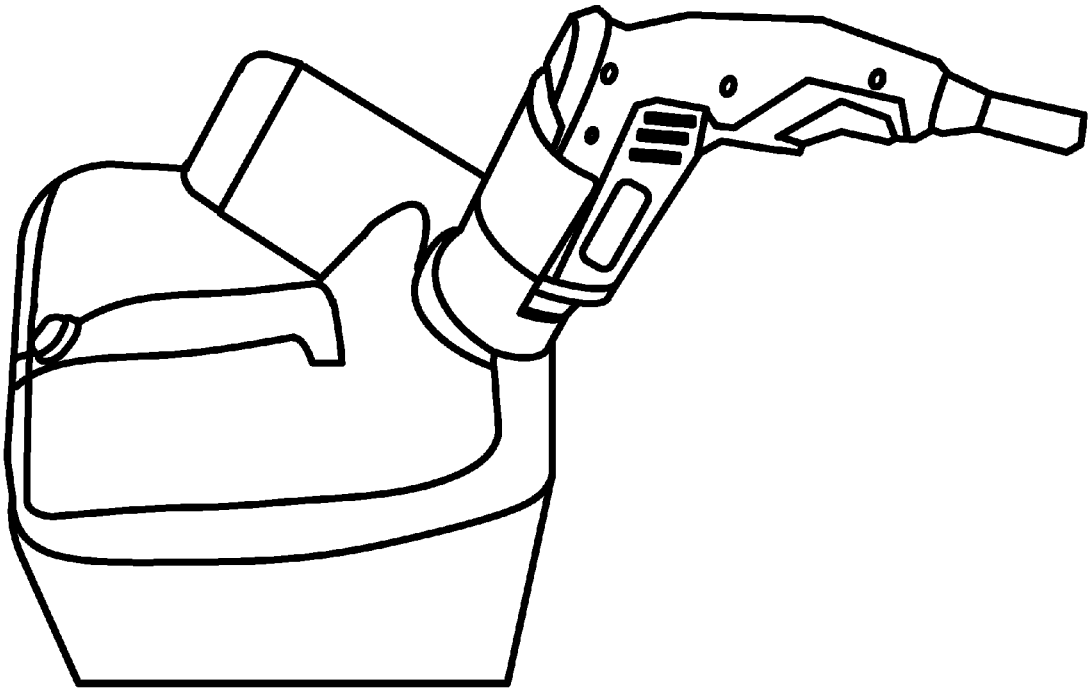
Figure 12:
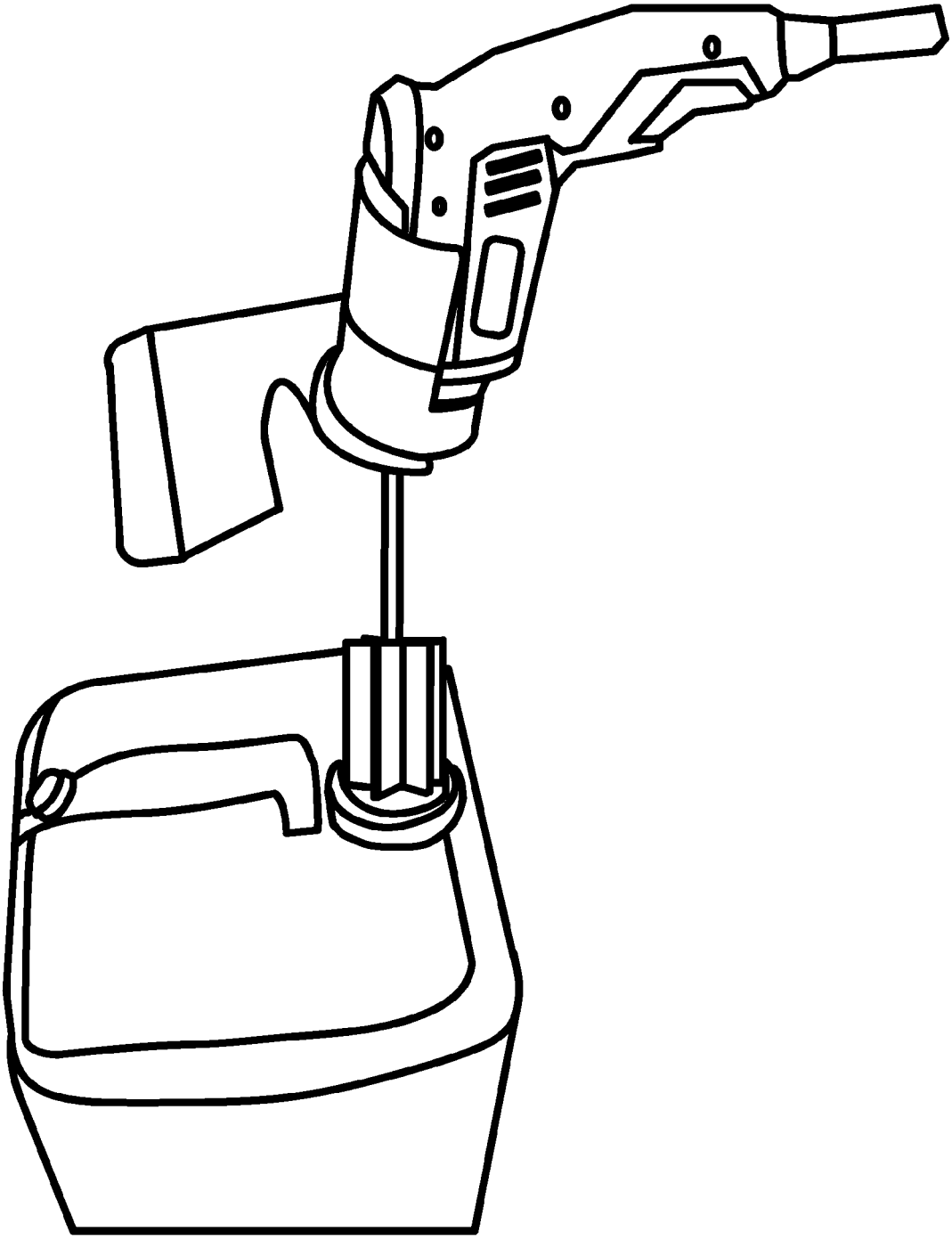
Figure 13:
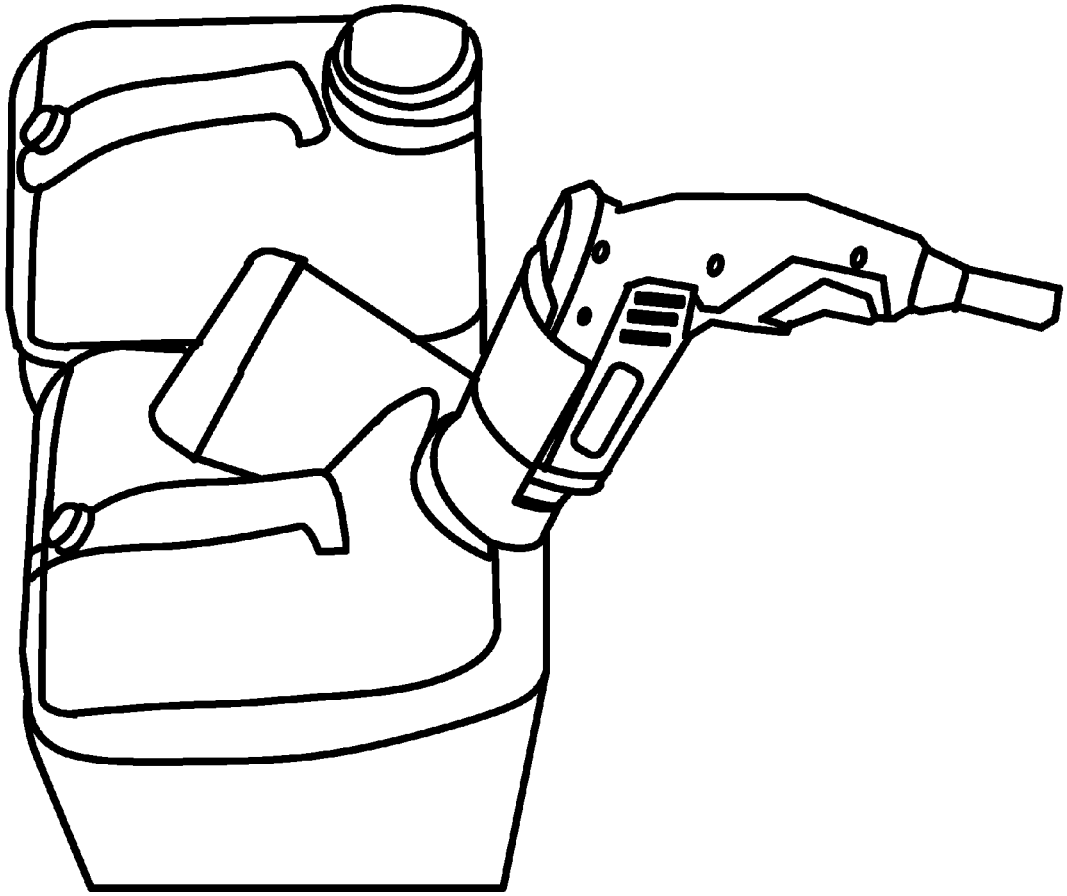
Figure 14:
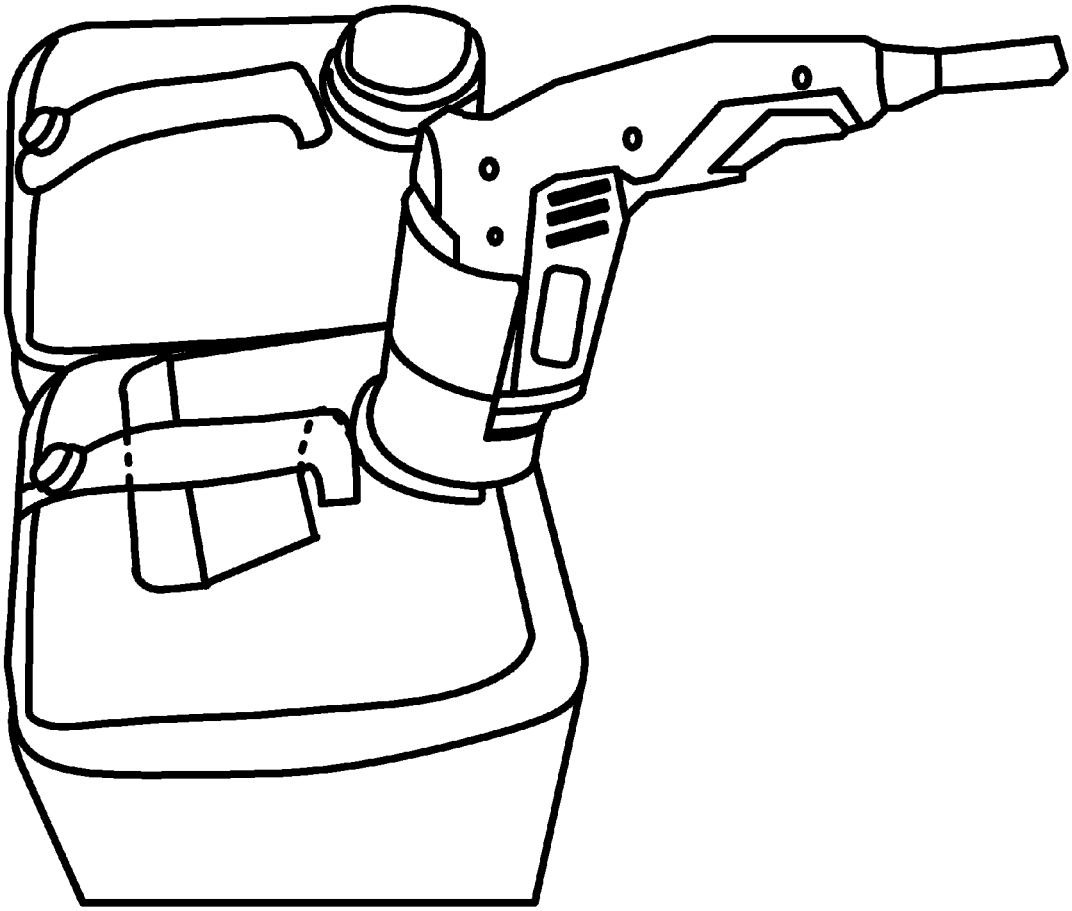

FIGS. 5-14 illustrate the method of use of an embodiment of the apparatus and system disclosed herein. FIG. 5 illustrates a user adding an ingredient to a fluid mixture in a second container in preparation for mixing, while the apparatus and system is in use in a first container. FIGS. 6 and 10 illustrate the apparatus and system locked in place with respect to the container and handle. FIGS. 7 and 11 illustrate the apparatus and system being unlocked and removed from engagement with the handle of the container. FIGS. 8 and 9 illustrate the apparatus and system being removed from the first container, while FIG. 12 illustrates the apparatus and system being inserted into the second container. FIGS. 8, 9 and 12 also illustrate the diameter of the entirety of the blades with respect to the diameter of the opening of the container. FIG. 13 illustrates the apparatus and system being attached and locked into place with respect to the container and handle. FIG. 14 illustrates the apparatus and system in use while the motor is actuated and providing torque to the apparatus and system.

In accordance with the features and combinations described above, a useful method of mixing fluids in a container may comprise:

attaching a self-retaining apparatus for mixing fluids to a container, wherein the apparatus comprises:

a frame member that is mechanically coupled to a motor, wherein the frame member comprises a saddle and a securing plate for connecting and retaining the frame member with respect to a container; and a mixing paddle comprising a plurality of blades and a drive shaft, wherein the plurality of blades are in mechanical communication with the drive shaft and wherein the drive shaft is in mechanical communication with the motor;

wherein the frame member comprises a slot that is configured and dimensioned to interact with and contact a portion of the container to thereby connect and retain the frame member in a certain location with respect to the container without requiring a user to grasp and hold the self-retaining apparatus; and actuating a motor such that the drive shaft of the mixing paddle is caused to rotate thereby imparting torque from the motor to the plurality of blades due to the mechanical communication between the motor, drive shaft and plurality of blades.

It will be appreciated that all numbers, degrees, percentages, and the like that fall within or between the ranges disclosed herein are intended to fall within the scope of the disclosure as if each number, degree, percentage and the like was individually disclosed. For example, in an embodiment, the angle θ has been disclosed as being formed between the first portion 115 and the second portion 117 and that such angle θ may fall within a range of about ten degrees and about thirty degrees. All angles falling within the range of about ten degrees to about thirty degrees are to be considered individually disclosed, such that eleven degrees, twelve degrees, thirteen degrees, fourteen degrees and so on are all disclosed as part of the disclosure and fall within the specified range, whether the exact number, degree or percentage is exactly specified or not.

Those having ordinary skill in the relevant art will appreciate the advantages provide by the features of the disclosure. For example, it is a potential feature of the disclosure to provide a portable, self-retaining fluid mixing apparatus, system and method that is simple in design and manufacture. Another potential feature of the disclosure is to provide such a fluid mixing apparatus that is self-retaining and capable of being used with a first container while the user is attending to the needs of a second container. It is a further potential feature of the disclosure, in accordance with one aspect thereof, to provide a mixing fluid apparatus and system that is portable and capable of being carried by hand.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A self-retaining apparatus for mixing fluids within a container, comprising:

a frame member comprising a saddle configured to receive a motorized device and a securing plate for connecting and retaining the frame member to a container; and a mixing paddle comprising a plurality of blades and a drive shaft, wherein the plurality of blades are in mechanical communication with the drive shaft and wherein the drive shaft is in mechanical communication with a motor of the motorized device, such that when the motor is actuated the drive shaft rotates thereby imparting torque from the motor to the plurality of blades due to the mechanical communication between the motor, drive shaft and plurality of blades;

wherein the securing plate extends from a first end proximal to the saddle in a lateral direction away from an axis of the drive shaft and wherein the securing plate forms a slot that is configured and dimensioned to, when the frame member is rotated in a first direction around the axis of the drive shaft, interact with and contact a handle of the container to thereby connect and retain the frame member with respect to the container without requiring a user to grasp and hold the self-retaining apparatus and, when the frame member is rotated in a second direction around the axis of the drive shaft, release the securing plate from the handle.

2. The self-retaining apparatus of claim 1, wherein the slot comprises an open end and a closed end opposite the open end, wherein the open end faces in a direction parallel to a surface of the securing plate and at least partially perpendicular to the drive shaft.

3. The self-retaining apparatus of claim 1, wherein the securing plate comprises a substantially planar first portion having an end that forms a portion of the slot.

4. The self-retaining apparatus of claim 3, wherein the securing plate further comprises a substantially planar second portion, wherein the second portion is formed at an angle with respect to the first portion, such that the first portion and the second portion are not co-planar.

5. The self-retaining apparatus of claim 4, wherein the angle formed between the first portion and the second portion is within a range of about ten degrees and about thirty degrees with respect to an imaginary plane that is parallel to a surface of the first portion of the securing plate.

6. The self-retaining apparatus of claim 5, wherein the angle is within a range of about fifteen degrees to about twenty-five degrees.

7. The self-retaining apparatus of claim 6, wherein the angle is about twenty degrees.

8. The self-retaining apparatus of claim 1, wherein the slot is positioned between the securing plate on one side and the saddle on the other side, such that the slot is formed by the saddle and the securing plate.

9. The self-retaining apparatus of claim 1, wherein a ratio exists between a length L1 of the slot to a length L2 of the securing plate that is within a range of about 0.15 to about 0.75.

10. The self-retaining apparatus of claim 9, wherein the ratio is within a range of about 0.20 to about 0.50.

11. The self-retaining apparatus of claim 10, wherein the ratio is within a range of about 0.25 to about 0.30.

12. The self-retaining apparatus of claim 1, wherein a ratio exists between a length L3 of the saddle to a length L2 of the securing plate that is within a range of about 1 to about 1.25.

13. The self-retaining apparatus of claim 12, wherein the ratio is between a range of about 1.10 and about 1.20.

14. The self-retaining apparatus of claim 1, wherein the saddle comprises a first portion having a curved surface for engaging a housing for the motorized device, and a second portion having a tubular portion for receiving a portion of the housing for the motorized device therein, wherein the saddle is configured and dimensioned to couple the frame member to the motorized device.

15. The self-retaining apparatus of claim 14, wherein the frame member comprises a fastening member for securing the first portion of the saddle to the motorized device.

16. The self-retaining apparatus of claim 1:

wherein the securing plate comprises a substantially planar first portion having an end that forms a portion of the slot;

wherein the securing plate further comprises a substantially planar second portion, wherein the second portion is formed at an angle with respect to the first portion, such that the first portion and the second portion are not co-planar;

wherein the angle formed between the first portion and the second portion is within a range of about ten degrees and about thirty degrees with respect to an imaginary plane that is parallel to a surface of the first portion of the securing plate;

wherein the slot is positioned between the securing plate on one side and the saddle on the other side, such that the slot is formed by the saddle and the securing plate;

wherein a ratio exists between a length L1 of the slot to a length L2 of the securing plate that is within a range of about 0.15 to about 0.75;

wherein a ratio exists between a length L3 of the saddle to a length L2 of the securing plate that is within a range of about 1 to about 1.25;

wherein the saddle comprises a first portion having a curved surface for engaging a housing for the motorized device, and a second portion having a tubular portion for receiving a portion of the housing for the motorized device therein, wherein the saddle is configured and dimensioned to couple the frame member to the motorized device; and wherein the frame member comprises a fastening member for securing the first portion of the saddle to the motorized device.

17. A system for mixing fluids within a container, comprising:

a motorized device for providing torque; and a self-retaining apparatus comprising:

a frame member that is mechanically coupled to the motorized device, wherein the frame member comprises a saddle configured to receive the motorized device therein and a securing plate for connecting and retaining the frame member to a container; and a mixing paddle comprising a plurality of blades and a drive shaft, wherein the plurality of blades are in mechanical communication with the drive shaft and wherein the drive shaft is in mechanical communication with a motor of the motorized device, such that when the motor is actuated the drive shaft rotates thereby imparting torque from the motor to the plurality of blades due to the mechanical communication between the motor, drive shaft and plurality of blades;

wherein the securing plate extends from a first end proximal to the saddle in a lateral direction away from an axis of the drive shaft and wherein the securing plate forms a slot that is configured and dimensioned to, when the frame member is rotated in a first direction around the axis of the drive shaft, interact with and contact a handle of the container to thereby connect and retain the frame member with respect to the container without requiring a user to grasp and hold the self-retaining apparatus and, when the frame member is rotated in a second direction around the axis of the drive shaft, release the securing plate from the handle.

18. The self-retaining apparatus of claim 17, wherein the slot comprises an open end and a closed end opposite the open end, wherein the open end faces in a direction parallel to a surface of the securing plate and at least partially perpendicular to the drive shaft.

19. The self-retaining apparatus of claim 17, wherein the securing plate comprises a substantially planar first portion having an end that forms a portion of the slot.

20. The self-retaining apparatus of claim 19, wherein the securing plate further comprises a substantially planar second portion, wherein the second portion is formed at an angle with respect to the first portion, such that the first portion and the second portion are not co-planar.

21. The self-retaining apparatus of claim 20, wherein the angle formed between the first portion and the second portion is within a range of about ten degrees and about thirty degrees with respect to an imaginary plane that is parallel to a surface of the first portion of the securing plate.

22. The self-retaining apparatus of claim 21, wherein the angle is within a range of about fifteen degrees to about twenty-five degrees.

23. The self-retaining apparatus of claim 22, wherein the angle is about twenty degrees.

24. The self-retaining apparatus of claim 17, wherein the slot is positioned between the securing plate on one side and the saddle on the other side, such that the slot is formed by the saddle and the securing plate.

25. The self-retaining apparatus of claim 17, wherein a ratio exists between a length L1 of the slot to a length L2 of the securing plate that is within a range of about 0.15 to about 0.75.

26. The self-retaining apparatus of claim 25, wherein the ratio is within a range of about 0.20 to about 0.50.

27. The self-retaining apparatus of claim 26, wherein the ratio is within a range of about 0.25 to about 0.30.

28. The self-retaining apparatus of claim 17, wherein a ratio exists between a length L3 of the saddle to a length L2 of the securing plate that is within a range of about 1 to about 1.25.

29. The self-retaining apparatus of claim 28, wherein the ratio is between a range of about 1.10 and about 1.20.

30. The self-retaining apparatus of claim 17, wherein the saddle comprises a first portion having a curved surface for engaging a housing for the motorized device, and a second portion having a tubular portion for receiving a portion of the housing for the motorized device therein, wherein the saddle is configured and dimensioned to couple the frame member to the motorized device.

31. The self-retaining apparatus of claim 30, wherein the frame member comprises a fastening member for securing the first portion of the saddle to the motorized device.

32. A method of mixing fluids in a container comprising:

attaching a self-retaining apparatus for mixing fluids to a container, wherein the apparatus comprises:

a frame member that is mechanically coupled to a motorized device, wherein the frame member comprises a saddle configured to receive the motorized device therein and a securing plate for connecting and retaining the frame member to a container; and a mixing paddle comprising a plurality of blades and a drive shaft, wherein the plurality of blades are in mechanical communication with the drive shaft and wherein the drive shaft is in mechanical communication with a motor of the motorized device;

wherein the securing plate extends from a first end proximal to the saddle in a lateral direction away from an axis of the drive shaft and wherein the a securing plate forms slot that is configured and dimensioned to, when the frame member is rotated in a first direction around the axis of the drive shaft, interact with and contact a handle of the container to thereby connect and retain the frame member to the container without requiring a user to grasp and hold the self-retaining apparatus and, when the frame member is rotated in a second direction around the axis of the drive shaft, release the securing plate from the handle; and actuating a motor such that the drive shaft of the mixing paddle is caused to rotate thereby imparting torque from the motor to the plurality of blades due to the mechanical communication between the motor, drive shaft and plurality of blades; and wherein a result of the torque from the motor provides a retention force thereby holding the slot in contact with the handle.

* * * * *